US009540128B2

(12) United States Patent
Monti

(10) Patent No.: US 9,540,128 B2
(45) Date of Patent: Jan. 10, 2017

(54) SYSTEM FOR SYNCHRONISING WORK STATIONS OF A BLISTER-PACKING MACHINE WITH ADVANCEMENT OF A BLISTER PACK

(71) Applicant: MARCHESINI GROUP S.p.A., Pianoro, Bologna (IT)

(72) Inventor: Giuseppe Monti, Bologna (IT)

(73) Assignee: MARCHESINI GROUP S.p.A., Pianoro (Bologna) (IT)

( * ) Notice: Subject to any disclaimer, the term of this patent is extended or adjusted under 35 U.S.C. 154(b) by 499 days.

(21) Appl. No.: 14/249,751

(22) Filed: Apr. 10, 2014

(65) Prior Publication Data

US 2014/0305073 A1 Oct. 16, 2014

(30) Foreign Application Priority Data

Apr. 12, 2013 (IT) ..... BO2013A0162

(51) Int. Cl.

| | |
|---|---|
| ***B65B 41/18*** | (2006.01) |
| ***B65B 61/06*** | (2006.01) |
| ***B65B 51/14*** | (2006.01) |
| ***B65B 57/04*** | (2006.01) |
| ***B65B 9/04*** | (2006.01) |

(52) U.S. Cl.

CPC ..... *B65B 41/18* (2013.01); *B65B 9/045* (2013.01); *B65B 51/14* (2013.01); *B65B 57/04* (2013.01); *B65B 61/06* (2013.01)

(58) Field of Classification Search

CPC ..... B65B 1/02; B65B 9/04; B65B 9/045; B65B 41/18; B65B 47/00; B65B 51/14; B65B 57/04; B65B 61/06

USPC ..... 53/51, 55, 246, 559, 329.3; 348/95

See application file for complete search history.

(56) References Cited

U.S. PATENT DOCUMENTS

| | | | | |
|---|---|---|---|---|
| 4,349,997 | A | 9/1982 | Hayasaka et al. | |
| 4,545,174 | A | 10/1985 | Seko | |
| 4,610,649 | A * | 9/1986 | Friess | B31B 1/74 226/53 |
| 5,022,950 | A * | 6/1991 | Ingalls et al. | B44B 5/0009 53/51 |

(Continued)

FOREIGN PATENT DOCUMENTS

| | | | | |
|---|---|---|---|---|
| DE | 3201315 | A1 * | 7/1983 | B65B 41/18 |
| DE | 10116104 | A1 * | 10/2002 | B65B 57/04 |

(Continued)

*Primary Examiner* — Stephen F Gerrity

(74) *Attorney, Agent, or Firm* — R. Neil Sudol; Henry D. Coleman

(57) ABSTRACT

A system for synchronizing work stations of a blister-packing machine with an advancing of a blister strip comprises three video cameras predisposed upstream of work stations having devices for operating on the advancing blister strip, respectively. Acquiring with the video cameras an image of a distinctive element present in the advancing blister strip. A processor and a computer program compare and calculate differences between the image with the distinctive element and a reference element inserted in the image. The processor and computer program intervene on the operating devices of the stations and/or on the advancement of the blister strip to make corrections so the operating devices of the work stations are in register with the advancement of the blister strip.

5 Claims, 4 Drawing Sheets

(56) References Cited

U.S. PATENT DOCUMENTS 5,269,123 A * 12/1993 Marchesini ..... B65B 41/18 53/51
5,732,529 A * 3/1998 Dey et al. ..... B65H 23/0326 53/559
5,966,908 A * 10/1999 Philipp et al. ..... B65B 9/067 53/51
6,109,000 A 8/2000 Conti
6,386,851 B1 * 5/2002 Gustafsson ..... B65B 41/18 226/2
7,762,301 B2 * 7/2010 Mathea ..... B65H 23/1882 53/51
2002/0153292 A1 * 10/2002 Monti ..... B65B 57/20 209/577
2003/0079446 A1 * 5/2003 Behnke ..... B65B 9/045 53/473
2004/0123568 A1 * 7/2004 Send ..... B65B 41/18 53/51
2008/0016824 A1 1/2008 Rodi
2009/0229951 A1 * 9/2009 Monti ..... B65G 47/1471 198/401
2010/0018154 A1 * 1/2010 Laperche ..... B65B 9/045 53/53
2010/0112916 A1 5/2010 Epstein et al.
2011/0094195 A1 * 4/2011 Bartoli et al. ..... B65B 61/06 53/558
2013/0074664 A1 * 3/2013 Ewald ..... B65B 61/065 83/13
2013/0091804 A1 * 4/2013 Boland ..... B65B 9/045 53/396
2013/0227914 A1 * 9/2013 Allgaier et al. ..... B65B 57/04 53/285
2014/0096490 A1 * 4/2014 Regner et al. ..... B65B 9/045 53/473
2014/0123606 A1 * 5/2014 Ehrat ..... B65B 5/105 53/473
2014/0150377 A1 * 6/2014 Ehrmann et al. ..... B65B 57/04 53/559
2015/0096263 A1 * 4/2015 Ehrmann ..... B65B 9/04 53/411
2015/0353219 A1 * 12/2015 Kohl ..... B65B 57/04 53/473
2015/0367970 A1 * 12/2015 Barrett et al. ..... B65B 9/045 53/553

FOREIGN PATENT DOCUMENTS

EP 0960024 A1 * 12/1999 ..... B65B 41/18
EP 1172299 A1 * 1/2002 ..... B65B 41/18
EP 2301850 A2 * 3/2011 ..... B65B 57/04
WO WO 9929508 A1 * 6/1999 ..... B65B 41/18
WO WO 2007107021 A1 * 9/2007 ..... B65B 9/045

* cited by examiner

FIG. 5
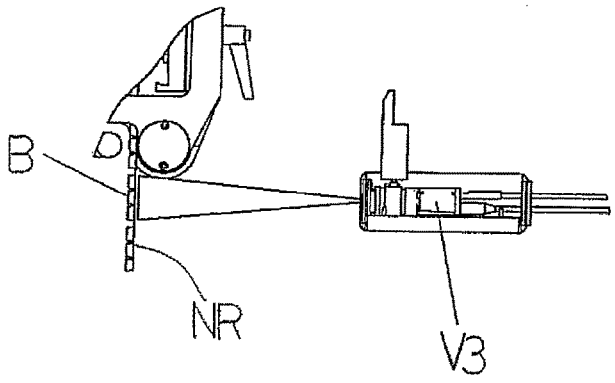
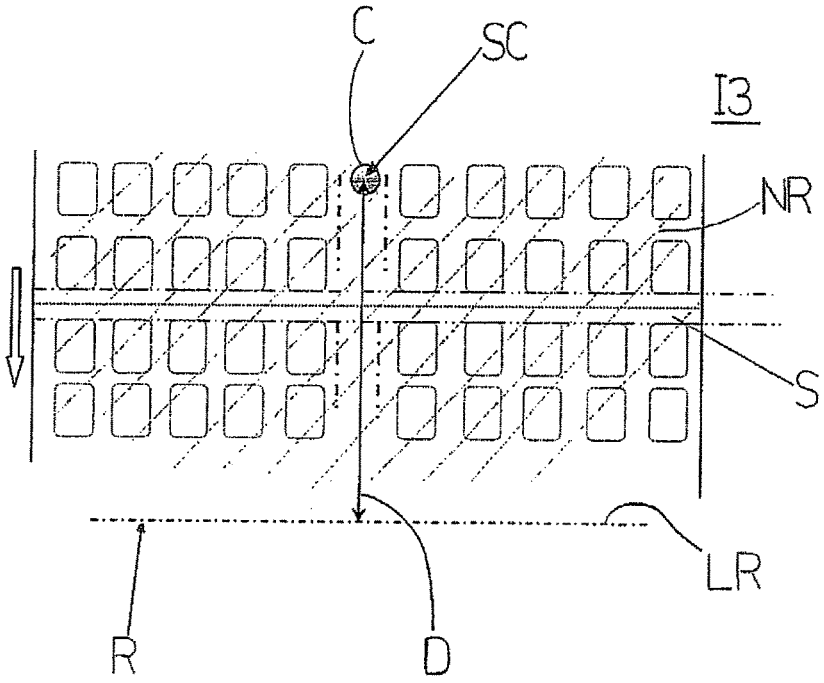
FIG. 6

SYSTEM FOR SYNCHRONISING WORK STATIONS OF A BLISTER-PACKING MACHINE WITH ADVANCEMENT OF A BLISTER PACK

FIELD OF THE INVENTION

The present invention relates to the particular technical sector concerning automatic apparatus for packing products, such as for example pharmaceutical or para-pharmaceutical products, internally of blister packs.

DESCRIPTION OF THE PRIOR ART

These apparatus, known in the sector as blister-packing machines, include using a strip made of a heat-forming material and subjecting it to a heat-forming operation by means of application of heat (or possible by application of compressed air) for realizing cells constituting the receiving seatings for the products to be packed.

The strip heat-formed in this way is also referred-to in the sector as a blister pack, and it will be termed thus in the following.

According to the type, structure and lay-out of the blister-packing machine, the blister strip is advanced according to a given advancement pathway so that it transits, during the advancement thereof, through a series of work stations, in each of which special operating means are predisposed and operate, commanded by relative motor organs, which operating means are destined to carry out specific work steps on the blister strip.

Blister-packing machines usually comprise, downstream of the zone where the heat-formable strip is subjected to the step of heat-forming the cells, and arranged in sequence one after another, at least the following work stations: a first work station predisposed to carry out the inserting of the products internally of the cells of the blister strip, a second work station predisposed to arranged a cladding and covering strip above the blister strip, the cells of which have been filled with the products, and to carry out the sealing of the covering to the blister strip, and a third work station predisposed to carry out the cutting of the blister strip thus-sealed and obtain the single blister packs which will then be inserted internally of the relative boxes.

The main problem area in blister-packing machines, and particularly long-lamented by the technical experts in the sector, is without doubt how to predispose measures and specifications with which to command, actuate and duly synchronise the operating means of each work station according to the effective position of the cells of the blister pack during the transit thereof through the work station.

This set of problems is mainly a consequence of the fact that following the heat-welding operations on the heat-formable strip this strip is subject, due to the application of heat and the subsequent cooling, to changes in shape and length (for example it is elongated due to the heat applied then to be shortened because of the cooling) and its behaviour is not always constant and identical over time.

Therefore, it is not a priori possible to know, nor predict, what the effective and real position of the cells present in the blister strip will be when the blister strip, once having exited the heat-forming station, is advanced towards the successive work stations.

Further, another problem encountered and which adds to the one described above, is dictated by the fact that the blister pack advances continuously through the majority of the work stations present in the blister-packing machine and this leads, without doubt, to a further difficulty for determining in real-time the effective position of the cells of the blister strip when it transits through a given work station.

For example, it is of fundamental importance to know the effective position of the cells of the blister strip when they are arriving at the filling and supply station of the products so as to be able in consequence to actuate the release means predisposed to perform the operations so that they can release the products when they are exactly positioned above the cells, and advance in synchrony with the cells at least over a common portion of advancement, for the time necessary for the products to be released and to fall with certainty into the cells.

The same consideration can be made for the work station predisposed to apply the covering strip above the blister strip filled with the products and to perform the reciprocal welding.

This station can comprise a pair of heat-welding plates opposite one another and predisposed so as to lock and grip the two strips, sealing them to one another. The lower plate is duly provided with recesses destined to house internally thereof the cells of the blister strip, without damaging them, during the sealing operations.

It is clear that the knowledge of the effective and real position of the cells present in the portion of blister strip in arrival at the sealing station is of fundamental importance for having a perfect synchronisation between the advancing of the plates and the advancing of the blister strip, so as to prevent the lower plate from damaging the cells if the relative recesses present therein are not correctly and perfectly centred with respect to the cells.

Lastly, a very similar consideration can be made also for the cutting station, where the means for carrying out the cutting of the blister strip to separate the various and second blister packs must be commandable adequately with respect to the effective position assumed by the cells when the blister strip reaches the station.

The systems at present used for carrying out the synchronisation of the operating means of the work stations of a blister-packing machine with the advancing of the blister strip have not been shown to be particularly efficient.

For example, a system used at present involves the use of photocell sensors, comprising at least an emitting element and at least a receiving element, which are predisposed on opposite sides of the blister strip in a position upstream of a work station so that the light beam emitted by the emitting element and destined to be captured by the receiving element can be interrupted each time the cells of the advancing strip intercept and interrupt this beam, so that the system can have a signal indicating the passage of the cells and consequently can send a pulse to the operating means of the work station so as to advance or delay actuation thereof.

A system such as the one described above exhibits various drawbacks.

Firstly this detecting system, using photocell sensors, is strongly influenced by the shape of the cells and the effective position of the blister strip, which during the advancement thereof towards the work station does not exhibit a single orientation and position in height.

It can in fact happen that the blister strip advancing towards a work station is slightly displaced upwards or downwards, given an equal distance of the central axis of the cells from the work station.

Very often the cells exhibit, with respect to the central axis thereof, inclined, curved or oblique walls, and consequently, in these cases, the sensors or photocells detect different distances according to the effective height-position of the blister strip, with respect to the effective distance of the central axis of the cells.

Secondly, a system of this type includes controlling the actuation of the operating means of the work station by sending electrical command pulses to the motor organs responsible for the movement of the operating means, so as to advance or delay the actuation thereof according to whether the cells are closer to or further from a reference position.

However a control mode of the motor organs of this type cannot be precise with regard to the effective position of the cells present in the portion of blister strip which is advancing towards the work station.

Lastly, a problem which has not yet found a satisfactory solution and which is still present in the cutting stations of the blister-packing machines of the prior art relates to the possibility of carrying out and obtaining a cutting of the blister strip that is perfectly centred with respect to the welding that has been carried out upstream in the sealing station.

SUMMARY OF THE INVENTION

The aim of the present invention is therefore to disclose a system for synchronising work stations of a blister-packing machine with the advancing of the blister-packing machine able to obviate the drawbacks cited in the foregoing and present in the prior art.

In particular, the aim of the present invention is to provide a system able to precisely acquire the effective and real position of a distinctive element present in the portion of a blister strip advancing towards a work station, so as to be able consequently to synchronise the actuation of the operating means of the work station.

The aims are obtained according to a system for synchronizing work stations of a blister-packing machine with advancement of the blister strip as set forth below.

BRIEF DESCRIPTION OF THE DRAWINGS

The characteristics of the system for synchronizing work stations of a blister-packing machine with advancing of the blister strip proposed with the present invention are described in the following with reference to the appended tables of drawings, in which:

FIG. 5 is a larger-scale view of the detail denoted by the letter W in FIG. 1;

FIG. 6 schematically illustrates a particular operating step of the system disclosed by the invention;

FIG. 7 schematically illustrates, in a larger scale, detail Y of FIG. 1, in order to illustrate operating means of a work station of the blister-packing machine, in a particular work configuration, which shows a significant element of the system of the invention, while

DESCRIPTION OF THE PREFERRED EMBODIMENTS

Figure 1:
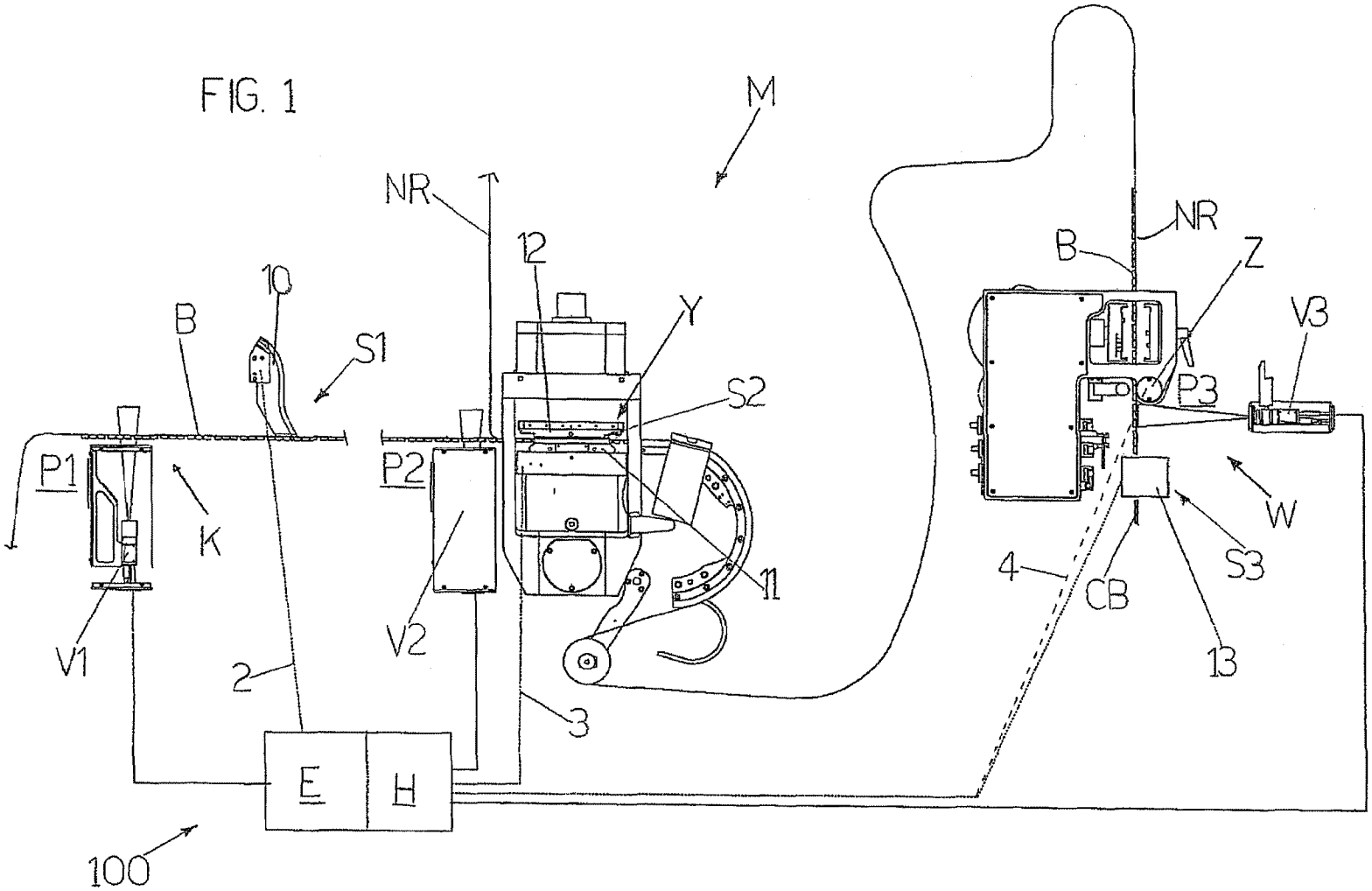
FIG. 1 illustrates a lateral partial schematic view of a blister-packing machine in which the system, of the present invention is applied.

FIG. 1 illustrates, in a partial lay-out of a type of a blister-packing machine (M) in which, as with all blister-packing machines, the blister-packing machine (B) provided with cells for receiving the products is advanced along a given advancement pathway which crosses a series of work stations (S1, S2, S3).

By way of example, the schematic illustration of the blister-packing machine illustrated in FIG. 1 has been represented starting from a point in which the blister strip (B) has already been heat-formed, i.e. the cells have already been realized by heat-forming, and this schematic representation illustrates a series of work stations (S1, S2, S3) in which particular work operations are performed on the blister strip (B) when the blister strip (B), advanced along the advancement pathway, time-by-time crosses a given work station.

For example, in the schematic representation of the blister-packing machine (M) of FIG. 1, the machine includes work stations (S1, S2, S3) respectively for carrying out the filling of the cells with relative products, for covering and sealing the blister strip filled with products with a covering strip, and lastly for cutting and shearing the sealed strip so as to obtain single blister packs.

The blister-packing machine (M) of FIG. 1 therefore comprises:

a first work station (S1) provided with operating means (10) comprising at least an operating means (10) mobile above the blister strip so as to carry out the filling of the cells with relative products;

a second work station (S2), downstream of the first station (S1), in which the blister pack (B) is covered with a covering strip (NR) and the two strips reciprocally sealed, which is provided with operating means (11, 12) comprising at least a pair of sealing plates (11, 12) superposed on one another and reciprocally mobile nearingly, so as to lock between them the two strips and seal them reciprocally, and distancingly, so as to release the sealed strips, with the lower plate (11) of the pair and which is provided with recesses of a suitable shape so as to be able to receive internally thereof the cells of the blister strip without damaging them, a third work station (S3), downstream of the second station (S2), for cutting the blister strip (B) sealed with the covering strip (NR) so as to obtain single blister packs (CB), in which use is included of operating means (13) comprising cutting means (13) (schematically illustrated by a rectangle as of known type) movable transversally with respect to the sealed blister strip so as to carry out the cutting and the movement means (Z) of the sealed strip and responsible for advancing the sealed strip towards, and position it, at the cutting means (13).

The system disclosed by the present invention is described in the following with reference to the type of blister-packing machine (M) illustrated in FIG. 1, but can be applied in any other type of blister-packing machine having a lay-out and advancing pathway of the blister strip that are different from the ones illustrated, where the various operating stations are autonomously commanded, and the relative operating means autonomously actuated.

FIG. 1 denotes, using reference number (100), the system of the invention, in its entirety, for synchronising work stations (S1, S2, S3) of a blister-packing machine (M) with advancement of the blister strip (B).

The system (100) comprises:

at least a video camera ((V1, V2, V3) able to precisely acquire an image of an object in movement which is predisposed in a position (P1, P2, P3) upstream of a work station (S1,S2, S3) of the blister-packing machine (M) with respect to the advancement path of the blister strip (B) such that the lens of the first video camera (V1, V2,V3) is facing towards a region of space through which the blister strip (B) transits before reaching the work station, the video camera (V1, V2, V3) being activatable such as to acquire an image (I1, I2, I3) of a portion of the blister strip (B) in transit through said region of space in which image (I1, I2, I3) a repetitive distinctive element (C) present in the blister strip (B) is visible; and an electronic processor (E) provided with a memory (H) (schematically represented by way of example internally of a rectangle in FIG. 1), which is connected to the video camera (V1, V2, V3), in such a way as to be able to receive from the video camera (V1, V2, V3) the image (I1, I2, I3) acquired from the portion of blister strip which has transited through the region of space, and which is further connected to the operating means (10, 11, 12, 13) of the work station (S1, S2, S3) and to movement means (Z) responsible for the advancing of the blister strip (B) along the advancement pathway in the blister-packing machine (M).

The system further comprises (100) a computer program, loaded in the memory (H) of the electronic processor (E), which enables the system to actuate the method of the invention as described in the preceding.

In particular, the computer program is predisposed for:

processing, as a function of the value of the distance between the positions of the video cameras (V1, V2, V3) and the work stations (S1, S2, S3), a reference element (R) corresponding to a correct register distance which the repetitive distinctive element (C) present in the portion of blister strip must have from said reference element (R) when the portion of blister strip transits from the regions of space so that the operating means (10, 11, 12, 13) of the work stations (S1, S2, S3), in normal and routine conditions of the operating work cycle thereof, are in register with the advancing of the blister strip such as to be able to perform the work operations to be made on the blister strip;

processing the images (I1, I2, I3) acquired by the video cameras (V1, V2, V3) and received by the electronic processor (E) such as to: insert in the images (I1, I2, I3) the reference element (R), identifying on the images (I1, I2, I3) acquired from the video cameras (V1, V2, V3) the effective position of the repetitive distinctive element (C), calculating the effective distance (D) between the position of the repetitive distinctive element (C) and the reference element (R), comparing the effective distance (D) obtained with the register distance, and if the value of the effective distance (D) obtained is different from the register distance, supplying a corresponding signal to the electronic processor (E).

In this way the electronic processor (E), on the basis of the signal received, can send a corresponding command signal to the operating means (10, 11, 12, 13) of the work station (S1, S2, S3) for commanding and actuating the operating means (10, 11, 12, 13) with a functioning regime that is different from the routine functioning cycle so as to match and synchronise the movement thereof as a function of the effective distance (D) of the distinctive element (C) from the reference element (R), but also send, according to individual cases, a corresponding command signal to the movement means (Z) responsible for the advancement of the blister strip to command and actuate the movement means (Z) in order for the means (Z) to be able vary the entity of the advancement of the blister strip towards the work station (S1, S2, S3) according to the effective distance (D) of the distinctive element (C) from the reference element (R).

The system can include using an own electronic processor with an own memory on which the computer program is loaded, or, alternatively but entirely equivalently, the system can comprise using the electronic processor already present in the blister-packing machine for managing the functioning of the operating means of the various work stations.

In the system (100), the electronic processor (E) and the computer program of the system loaded in the memory (H) of the processor (E) can be predisposed in such a way that:

when the value of the effective distance (D) between the distinctive element (C) and the reference element (R) is lower than the value of the register distance, the computer program sends to the processor (E) an advance information of the advancement of the strip towards the work station (S1, S2, S3) so that the electronic processor (E) can send a corresponding signal to the operating means (10, 11, 12, 13) of the work station (S1, S2, S3) and actuate and command the operating means (10, 11, 12, 13) in such a way as to command and actuate the operating means (10, 11, 12, 13) in advance with respect to the normal function operative cycle, corresponding to the difference detected between the register distance and the effective distance (D);

and when the value of the effective distance (D) between the distinctive element (C) and the reference element (R) is greater than the value of the register distance, the computer program sends to the processor (E) a delay information of the advancement of the strip (B) towards the work station (S1, S2, S3) so that the electronic processor (E) can send a corresponding signal to the operating means of the work station (S1, S2, S3) to activate and command the operating means (10, 11, 12, 13) so as to command and actuate the operating means (10, 11, 12, 13) with a phase delay, with respect to the normal operating work cycle, corresponding to the difference detected between the effective distance (D) and the register difference.

Further, the system (100) can also include that the electronic processor (E) and the computer program loaded in the memory (H) of the processor (E) are predisposed in such a way that:

when the value of the effective distance (D) between the distinctive element (C) and the reference element (R) is lower than the value of the register distance, the computer program sends to the processor (E) an advance information of the advancement of the strip towards the work station (S1, S2, S3) so that the electronic processor (E) can send a corresponding signal to the movement means (Z) responsible for the advancement of the blister strip (B) and actuate and command the means (Z) such that they intervene on the advancement of the strip to advance it with respect to the normal advancement thereof with a delay corresponding to the difference detected between the register distance and the effective distance (D);

and when the value of the effective distance (D) between the distinctive element (C) and the reference element (R) is greater than the value of the register distance, the computer program sends to the processor (E) a delay information of the advancement of the strip towards the work station (S1, S2, S3) so that the electronic processor (E) can send a corresponding signal to the movement means responsible for the advancement of the blister strip and actuate and command the means (Z) such that they intervene on the advancement of the strip so as to advance it with respect to the normal advancement thereof with an anticipation corresponding to the difference detected between the effective distance (D) and the register distance.

The system of the invention can therefore be applied to any type of blister-packing machine; FIG. 1 illustrates the system (100) applied to a blister-packing machine (M) having the lay-out as illustrated in FIG. 1.

In this case, the system (100) comprises a first video camera (V1), a second video camera (V2) and a third video camera (V3) which are predisposed in the following way.

The first video camera (V1) is predisposed in the first position (P1) with respect to the advancement path of the blister strip (B) in the blister-packing machine (M) such that the first video camera (V1) is situated upstream of a first work station (S1) of the blister-packing machine in which use of an operating means (10) is comprised above the blister strip (B), of the mobile means (10) for release of products internally of the cells of the blister strip (B).

Figure 2:
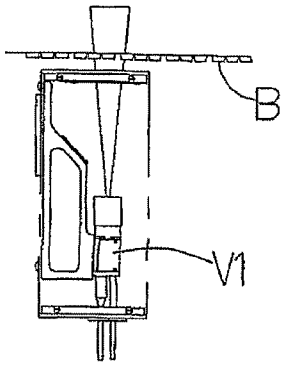
FIG. 2 represents a larger-scale view of the detail denoted by the letter K is FIG. 1.
Figure 3:
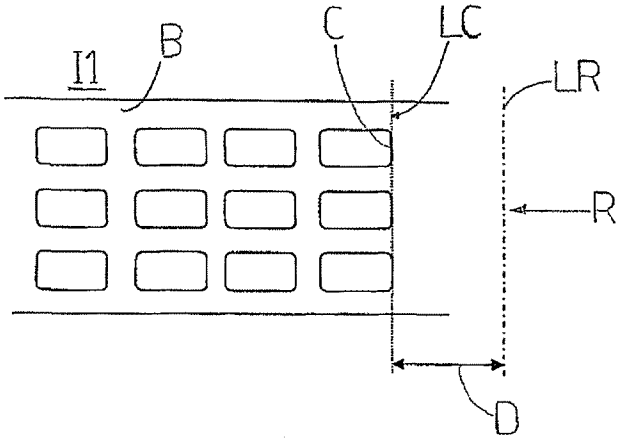
FIGS. 3 and 4 are schematic views of some special applicational steps of the system of the present invention according to two possible operating modes.
Figure 4:
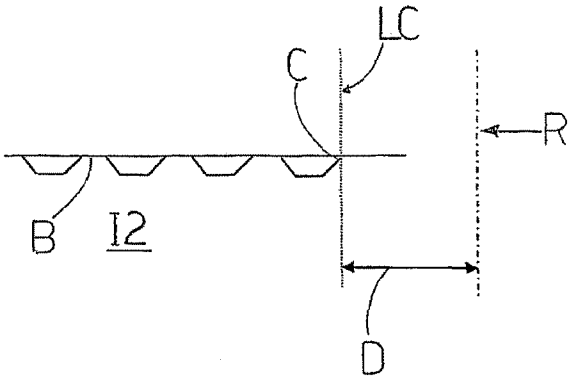
Figure 7:
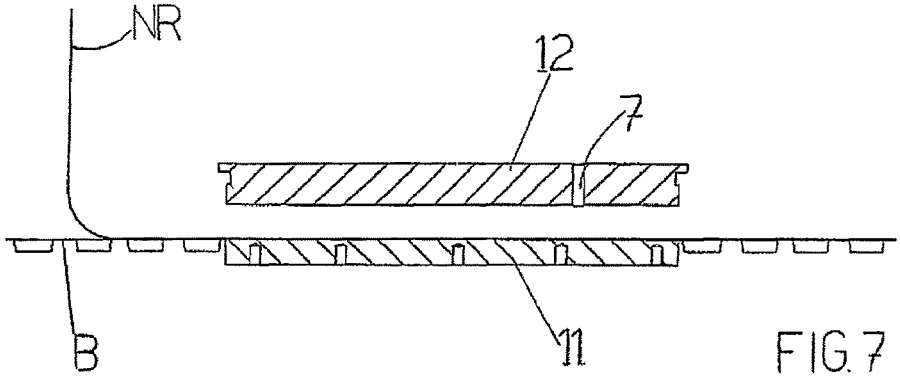
Figure 8:
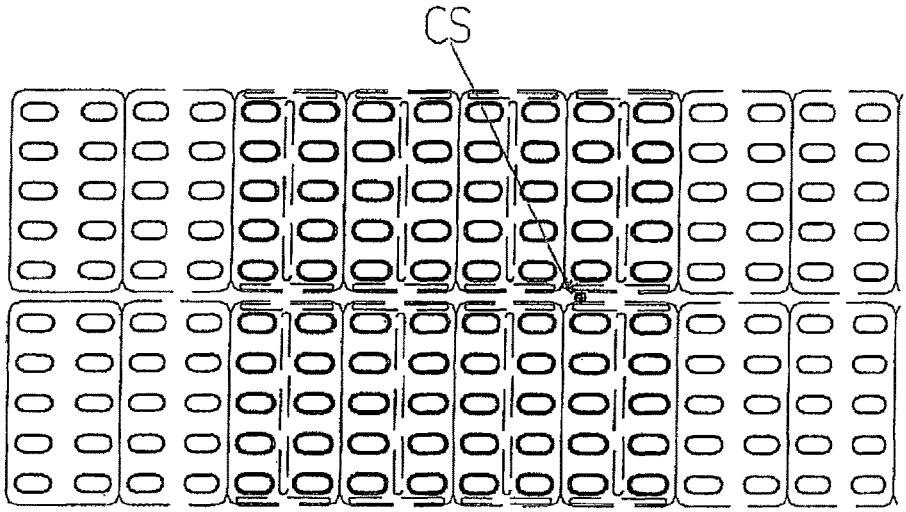
FIG. 8 illustrates a view from above of the part of FIG. 7 representing the zone where a covering strip is applied above the blister strip in order to be sealed.

The first video camera (V1) is predisposed in the first position (P1) in such a way that the lens thereof is facing towards the face of the blister strip in which the cells are present so that it can detect and acquire an image (I1) of the portion of blister strip in which a plan view is represented of the shape of the rows of cells present in the portion (see for example the detail of FIG. 2) or in which the lens is facing towards a side of the blister strip in order for it to be able to detect and acquire an image (I2) of the portion of the blister strip in which a lateral view is represented of the shape of the rows of cells present in the portion.

The second video camera (V2) is predisposed in a second position (P2) with respect to the advancement pathway of the blister strip (B) in the blister-packing machine (M) which is such that the second video camera (V2) is situated downstream of the first work station (S1) and upstream of a second work station (S2) for sealing the blister strip (B) filled with the products with a covering strip (NR), which includes the use of the pair of sealing plates (11, 12).

The second video camera (V2) is predisposed in the second position (P2) in such a way that the lens thereof is facing towards the face of the blister strip in which the cells are present so that it can detect and acquire an image (I1) of the portion of the blister strip in which a plan view is represented of the shape of the rows of cells present in the portion or in which the second video camera (V2) is predisposed in the second position (P2) so that the lens thereof is facing towards a side of the blister strip so that it can detect and acquire an image (I2) of the portion of blister strip in which a lateral view is represented of the shape of the rows of cells present in the portion.

The system (100) further includes connecting means (2) which connect the processor (E) to the mobile means (10) for release of products and connecting means (3) which connect the processor (E) to the pair of sealing plates (11, 12).

The system is such that the processor (E) and the computer program are predisposed for:

inserting, in the image (I1, I2), of the portion of blister strip acquired from the first video camera (V1), upstream of the mobile means (10) and in the image (I1, I2) of the portion of blister strip acquired from the second video camera (V2) upstream of the pair of sealing plates (11,12), a reference line (LR) transversal to the strip and perpendicular to the advancement direction of the strip towards the work station, representative of the reference element (R), in a position corresponding to a correct register distance that the advanced edge of a row of cells present in the portion of blister strip, representative of the repetitive distinctive element (C), must have from the reference line (LR) when the portion of blister strip transits from the region of space that is object of the field of action of the lens of the video camera so that the product-releasing mobile means (10) is in register with the cells during advancing of the blister strip and so that the recesses present in the lower plate (11) of the pair of sealing plates (11, 12) are in register and centred with respect to the cells of the strip;

identifying in the two images (I1, I2) the advanced edges of the row of cells constituting the distinctive element (C);

tracing, for each of the two images, a line (LC) passing through the advanced edges of the row of cells;

calculating, for each of the two images, the distance (D) between the line (LC) passing through the advanced edges of the row of cells and the reference line (LR) representing the reference element (R), and comparing the distance (D) obtained with the register distance.

In this way, on the basis of the effective value of the distance (D) obtained for each of the two images, the processor (E) can send:

a signal to the movable operating means (10) for release of products and command and activate the movable means (10) such that it is moved in register and centred with respect to the effective position of the cells of the advancing strip;

a signal to the pair of sealing plates (11, 12) and command and activate the pair of plates (11, 12) such that the recesses of the lower plate (11) are in register and centred with the effective position of the cells of the advancing blister strip.

For example, with the image acquired by the first video camera (V1) upstream of the mobile means (10), if the effective distance (D) obtained is less than the register distance, meaning that the advancement of the blister strip (B) is in advance by an entity equal to the difference between the register distance and the obtained distance, the processor (E) will command and actuate the mobile means (10) such that it advances the movement thereof with respect to the normal functioning cycle, by an entity equal to this difference, so that it will be perfectly centred at the effective position detected for the cells.

In the same way, with the image acquired by the first video camera (V1) upstream of the mobile means (10), if the value of the effective distance (D) obtained is greater than the value of the register distance, meaning that the advancement of the blister strip (B) is in delay by an entity equal to the difference between the obtained distance and the register distance, the processor (E) will command and actuate the mobile means (10) such that it delays the movement thereof with respect to the normal functioning cycle, by an entity equal to this difference, so that it will be perfectly centred at the effective position detected for the cells.

Correspondingly and likewise, the same thing happens for the image acquired by the second video camera (V2) and for the actuating of the pair of sealing plates (11, 12) by the processor (E).

The third video camera (V3) of the system (100) is instead predisposed in a third position (P3) with respect to the advancement path of the blister strip (B) in the blister-packing machine (M) such that the third video camera (V3) is situated downstream of the second sealing work station (S2), and upstream of a third work station (S3) for cutting the blister-packing machine (M) sealed with the covering strip (NR) in order to obtain single blister packs (CB), comprising cutting means (13) transversally movable with respect to the sealed blister strip in order to cut the strip and movement means (Z) of the sealed strip and responsible for advancing the sealed strip towards and position it at the cutting means (13).

The system (100) further comprises connecting means (4) which connect the processor (E) to the movement means (Z) of the sealed strip.

The system (100) of the invention specially has the third video camera (V3) predisposed such that it is situated at the opposite side of the blister strip side in which the cells are located so that the lens of the video camera (V3) is facing towards the covering strip (NR) (see for example the detail of FIG. 5), and comprises a marking means (7) predisposed upstream of the third video camera (V3) such as to apply a distinctive sign (CS) on the covering strip (NR) (see for example the detail of FIG. 5) at predetermined distances, identifying the distinctive element (C) representing the position of a welding strip (S) between the blister strip (B) and the covering strip (NR), at a center of which the cutting operation is to be performed.

In this case, the system (100) is such that the processor (E) and the computer program for the processor are predisposed such as:

- to insert, in the image (I3) of the portion of covering strip (NR) acquired by the third video camera (V3), a reference line (LR) transversal to the covering strip (NR) and perpendicular to the advancing direction of the strip towards the third cutting work station (S3), representing the reference element (R), in a position corresponding to a correct register distance which the repetitive distinctive sign (SC), applied to the covering strip (NR), must have from the reference line (LR) when the portion of sealed blister strip transits from the region of space that is object of the field of action of the third video camera (V3) so that the cutting means (13) of the third cutting work station (S3), in normal and routine conditions of the functioning work cycle thereof, are in register with the welding strip (S) and centred with respect to said welding strip (S) in such a way as to perform the cutting at the center of the welding strip (S);
- to determine from the acquired image (I3) the position of the distinctive sign (SC) previously applied by the marking means (7);
- to calculate the distance (D) between the distinctive sign (SC) and the reference line (LR) and comparing the distance (D) obtained with the register distance.

In this way, on the basis of the effective value of the distance (D) obtained, the processor (E) can send a signal to the movement means (Z) of the strip so as to command the means (Z) in such a way that they advance the strip towards the cutting station (S3) by an entity that is such that the strip will be positioned at the cutting means (13) so that they can carry out the cutting action perfectly in the center of the welded strip (S) (see the dotted line in FIG. 6).

For example, if for the image acquired by the third video camera (V3) the distance (D) obtained is less than the value of the register distance, meaning that the advancement of the blister strip (B) is in advance by an entity equal to the difference between the register distance and the obtained distance, the processor (E) will command and actuate the movement means (Z) of the strip so that the means (Z) advance the strip with a delay corresponding to the entity of the difference.

In this situation the strip will be in a more advanced position with respect to the ideal register position, in which the cutting action of the cutting means (13) is centred with respect to the position of the welding strip (S), and the difference obtained between the register distance and the effective distance (D) will correspond to the entity of the advance that the welding strip (S) has with respect to the register position thereof.

In this case the strip will be advance over an advancement distance having a smaller length with respect to the length of the operating advancement amount, so as to compensate for the fact that the effective position of the welding strip (S) is in a more advanced position with respect to the register position which it must have so that the cutting action of the cutting means (13) is perfectly centred with respect thereto.

This situation will be reversed in a case where in the image acquired by the third video camera (V3) the distance obtained (D) is greater than the register distance, which means that the strip is advancing with a delay of an amount equal to the difference between the distance obtained and the register difference; in this case the processor (E) will command and actuate the movement means (Z) of the strip so that the means (Z) advance the strip with an advance corresponding to the entity of the difference.

In this situation, the strip will be in a more retracted position with respect to the ideal register position, in which the cutting action of the cutting means (13) is centred with respect to the position of the welding strip (S), and the difference obtained between the effective distance (D) and the register difference, will correspond to the entity of the delay that the welding strip (S) has with respect to the register position.

In this case therefore, the strip will be advanced for an advancement tract having a greater length with respect to the length of the advancement amount at operating speed, so as to compensate for the fact that the effective position of the welding strip (S) is in a more retracted position with respect to the register position it must have so that the cutting action of the cutting means (13) is perfectly centred with respect thereto.

According to the invention, in the system (100) the marking means (7) is predisposed at the second work station (S2) in which the use of the pair of sealing plates (11, 12) is included.

In particular, the marking means (7) is predisposed such as to be associated to the upper plate (12) of the pair of sealing plates (see the detail of FIG. 6) so that when the pair of sealing plates (11, 12) is moved to block the blister strip (B) and the covering strip (NR) to one another, the marking means (7) goes into contact with the upper part of the covering strip (NR) so as to apply thereto a distinctive sign (CS).

The marking means (7) is predisposed in such a position that the distinctive sign (CS) applied to the covering strip (NR) is representative of the position of a welding strip (S) applied between the blister strip (B) and the covering strip (NR) by the pair of sealing plates (11, 12).

The video cameras of the system are predisposed internally of relative containers, and to each thereof is associated a relative lighting device specially predisposed so as to guarantee an excellent illumination of the region of space through which the portion of blister strip of which the video camera is to acquire the image transits.

The system (100) of the present invention is particularly advantageous in all those cases where there is a halting in the functioning of the blister-packing machine, for whatever reason.

In these cases, it is not possible to know the duration of the machine down-times and consequently it is not possible to predict the effective behaviour of the blister strip which, since the parts thereof closest to the heat-welding station of the cells (or the sealing station, where sealing is done using heat) cool down and can be subject to variations and changes in shape, for example the parts might be subject to shrinkage i.e. shortening. Consequently, at the moment the machine re-starts, the blister strip will have an effective position that is different from that of the shut-down moment, and the operating means of the work stations will no longer be in register, nor synchronized, with this new position.

The system (100) of the invention, thanks to the possibility of acquiring via the video cameras the positions of the blister strips at the moment of shut-down upstream of the work stations, and also at the moment when the blister-packing machine is about to resume its functioning, will be able to calculate whether the effective position of the blister strip upstream of the work stations has changed, or not, during the down-time, and consequently, by calculating the difference between the positions before the shut-down and at the moment of re-starting, will be able to actuate and command the operating means of the stations or the movement means of the strip so as to reset the synchrony thereof and the functioning thereof with respect to the effective position detected for the blister strip.

The invention claimed is:

1. A system for synchronising work stations of a blister-packing machine with advancement of a blister strip, a blister-packing machine in which the blister strip is advanced, being provided with cells for receiving products, in an advancement path which crosses in sequence: a first work station for supplying products, in which use is made above the blister strip of operating means comprising a mobile means for release of products internally of the cells of the blister strip, a second work station for sealing the blister strip filled with the products with a covering strip, where use is made of operating means comprising a pair of sealing plates superposed on one another and reciprocally nearingly movable such as to block the two strips to one another and reciprocally seal them, and distancingly movable in order to release the sealed strips, with the lower plate of the pair of sealing plates being provided with recesses having a suitable shape to receive internally thereof the cells of the blister strip without damaging them, a third work station for cutting the blister strip sealed with the covering strip such as to obtain single blister packs, in which use is made of operating means comprising cutting means movable transversally with respect to the sealed blister strip in order to perform the cutting thereof and movement means for moving the sealed strip responsible for advancing the sealed blister strip towards, and position it, at the cutting means, wherein it comprises:

a first video camera able to precisely acquire an image of an object in movement which is predisposed in a first position upstream of the first work station of the blister-packing machine with respect to the advancement path of the blister strip such that a lens of the first video camera is facing towards a region of space through which the blister strip transits before reaching said first work station, the first video camera being activatable such as to acquire an image of a portion of the blister strip in transit through said region of space in which image a repetitive distinctive element present in the blister strip is visible;

a second video camera, able to precisely acquire an image of an object in movement, which is predisposed in a second position, with respect to the advancement path of the blister strip, downstream of the first work station and upstream of the second work station in such a way that a lens of the second video camera is facing towards a region of space through which the blister strip transits before reaching said second work station, the second video camera being activatable such as to acquire an image of a portion of the blister strip in which image a repetitive distinctive element present in the blister strip is visible;

a third video camera, able to precisely acquire an image of an object in movement, which is predisposed in a third position, with respect to the advancement path of the blister strip, downstream of the second work station and upstream of the third work station, such that the third video camera is situated at the opposite side to the side of the blister strip in which the cells are located so that a lens of the third video camera is facing towards the covering strip, the third video camera being activatable such as to acquire an image of a portion of the blister strip sealed with the covering strip in which image a repetitive distinctive element present in the covering strip is visible;

an electronic processor provided with a memory, which is connected to the first video camera, to the second video camera and to the third video camera in such a way as to be able to receive from these video cameras the images acquired therefrom, connecting means which connect the processor to the mobile means for release of products of the first work station;

connecting means which connect the processor to the pair of sealing plates of the second work station;

connecting means which connect the processor to the movement means of the blister strip sealed with the covering strip;

a marking means for applying a distinctive sign on the covering strip which is predisposed such as to be associated to the upper plate of the pair of sealing plates of the second work station so that when the pair of sealing plates is moved to block the blister strip and the covering strip to one another, the marking means goes into contact with the upper part of the covering strip so as to apply thereto a distinctive sign, identifying said repetitive distinctive element, with the marking means which is predisposed in such a position that the distinctive sign applied to the covering strip is representative of the position of a welding strip applied between the blister strip and the covering strip by the pair of sealing plates;

a computer program, loaded in the memory of the electronic processor, the computer program being predisposed for: processing, as a function of the value of the distance between the positions of the video cameras and the work stations, a reference element corresponding to a correct register distance which the repetitive distinctive element must have from said reference element when the blister strip transits from the regions of space of the positions of the video cameras so that the operating means of the work stations, in normal and routine conditions of the operating work cycle thereof, are in register with the advancing of the blister strip such as to be able to perform the work operations to be made on the blister strip; processing the images acquired by the video cameras and received by the electronic processor such as to: insert in the images the reference element, identifying on the images acquired from the video cameras the effective position of the repetitive distinctive element, calculating the effective distance between the position of the repetitive distinctive element and the reference element, comparing the effective distance obtained with the register distance, and if the value of the effective distance obtained is different from the register distance, supplying a corresponding signal to the electronic processor such that the electronic processor sends a corresponding command signal to the mobile means for realizing products of the first work station and to the pair of sealing plates of the second work station so that to command said mobile means and said pair of sealing plates with a functioning that is different from the routine functioning cycle so as to match and synchronise the movement thereof as a function of the effective distance of the repetitive distinctive element from the reference element, and send a corresponding command signal to the movement means responsible for the advancement of the blister strip sealed with the covering strip to command and actuate the movement means in order for the means to vary the entity of the advancement of the sealed blister strip towards the cutting means of the third work station as a function of the effective distance of the distinctive element, applied by the marking means on the covering strip, from the reference element so that the movement means made to advance and position the sealed blister strip at the cutting means so that the cutting means are centered with respect to the effective position of the welding strip in order to perform and carry out the cut at the center of the strip.

2. The system of claim 1, wherein the electronic processor and the computer program loaded in the memory of the processor are predisposed in such a way as:

to insert, in the image of the portion of covering strip acquired by the third video camera, a reference line transversal to the covering strip and perpendicular to the advancing direction of the strip towards the third cutting work station, representing the reference element, in a position corresponding to a correct register distance which the repetitive distinctive sign, applied to the covering strip, must have from said reference line when the portion of sealed blister strip transits from the region of space that is object of the field of action of the lens of the third video camera so that the cutting means of the third work cutting station, in normal and routine conditions of the functioning work cycle thereof, are in register with the welding strip and centered with respect to said welding strip in such a way as to perform the cutting at the center of the welding strip;

to determine from the acquired image by the third video camera the position of the distinctive sign previously applied by the marking means at the second work station of sealing during the sealing of the covering strip to the blister strip;

to calculate the distance between the distinctive sign and the reference line and comparing the distance obtained with the register distance;

according to the effective value of the distance obtained, the computer program and the processor are predisposed in such a way that the processor can send a signal to the movement means of the strip and command and actuate the movement means in order for them to advance and position the sealed blister strip towards the third work cutting station by an entity such that the strip will be at the cutting means so that the cutting means are centered with respect to the effective position of the welding strip in order to perform and carry out the cut at the center of the strip.

3. System according to claim 2, wherein the electronic processor and the computer program loaded in the memory of the processor are predisposed in such a way that: if, in the image acquired by the third video camera, the distance obtained is lower than the register distance, meaning that the advancement of the sealed blister strip is in advance by an entity equal to the difference between the register distance and the distance obtained, that is the sealed blister strip is in an advanced position with respect to the register position in which the cutting action of the cutting means is centered with the position of the welding strip, the computer program and the processor are predisposed so that the processor command and activate the movement means in order for them to advance and position the sealed blister strip with a delay corresponding to said entity of said difference, and such that the electronic processor and the computer program loaded in the memory of the processor are predisposed in such a way that: if, in the image acquired by the third video camera, the distance obtained is greater than the register distance, meaning that the advancement of the sealed blister strip is delayed by an entity equal to the difference between the distance obtained and the register distance, that is the sealed blister strip is in a rearward position with respect to the register position, the computer program and the processor are predisposed so that the processor commands and actuates the movement means in order for them to advance and position the sealed blister strip with an advance corresponding to said entity of said difference.

4. The system of claim 2, wherein the first video camera is predisposed in the first position such that the lens of the first video camera is facing towards the face of the blister strip in which the cells are present so that it can detect and acquire an image of the portion of blister strip in which a plan view is represented of the shape of rows of cells present in the portion or in which the first video camera is predisposed in the first position such that the lens of the first video camera is facing towards a side of the blister strip in order for it to be able to detect and acquire an image of the portion of the blister strip in which a lateral view is represented of the shape of rows of cells present in the portion, and wherein the processor and the computer program are predisposed such that the processor can send a signal to the mobile means for release of products and command and activate the mobile means such that it is moved in register and centered with respect to the effective position of the cells of the advancing blister strip.

5. The system of claim 1, wherein the second video camera is predisposed in the second position in such a way that the lens of the second video camera is facing towards the face of the blister strip in which the cells are present so that it can detect and acquire an image of the portion of the blister strip in which a plan view is represented of the shape of rows of cells present in the portion or in which the second video camera is predisposed in the second position so that the lens of the second video camera is facing towards a side of the blister strip so that it can detect and acquire an image of the portion of blister strip in which a lateral view is represented of the shape of rows of cells present in the portion, and wherein the processor and the computer program are predisposed such that the processor can send a signal to the pair of sealing plates and command and activate the pair of sealing plates such that the recesses of the lower plate are in register and centered with the effective position of the cells of the advancing blister strip.

* * * * *